US006626423B2

(12) United States Patent
Doswell

(10) Patent No.: US 6,626,423 B2
(45) Date of Patent: Sep. 30, 2003

(54) LONGITUDINAL ENTRY CLIP FOR USE IN A VEHICLE JACK SYSTEM AND A VEHICLE JACK SYSTEM INCORPORATING THE SAME

(75) Inventor: Wayne Doswell, Richmond Hill (CA)

(73) Assignee: Ventra Group Inc., Bradford (CA)

( * ) Notice: Subject to any disclaimer, the term of this patent is extended or adjusted under 35 U.S.C. 154(b) by 0 days.

(21) Appl. No.: 09/837,195

(22) Filed: Apr. 19, 2001

(65) Prior Publication Data

US 2003/0085389 A1 May 8, 2003

(51) Int. Cl.[7] ..... B66F 3/24

(52) U.S. Cl. ..... 254/93 H; 254/DIG. 3; 254/1; 224/557; 224/543; 206/349; 206/373

(58) Field of Search ..... 254/931, 1, DIG. 3, 254/8 B, 2 B, 124; 224/557, 543, 522, 539, 545, 555; 206/349, 373

(56) References Cited

U.S. PATENT DOCUMENTS 2,649,191 A * 8/1953 McLaughlin ..... 206/16
3,513,969 A * 5/1970 Roff ..... 206/16
4,276,657 A * 7/1981 Montesi ..... 2/422
5,085,406 A * 2/1992 Schmaltz ..... 254/103
5,520,400 A * 5/1996 Hung ..... 280/47.26
6,230,949 B1 * 5/2001 O'Connell ..... 224/557

OTHER PUBLICATIONS

Ford Scissor Jack with Storage Case.

* cited by examiner

*Primary Examiner*—Joseph J. Hail, III
*Assistant Examiner*—Daniel Shanley
(74) *Attorney, Agent, or Firm*—Pillsbury Winthrop LLP

(57) ABSTRACT

A combination for use with a vehicle jack constructed and arranged to affect raising and lowering movements of the vehicle. The combination comprises an elongated rigid jack operating tool and a longitudinal entry tool retainer. The tool retainer is fixedly mounted to the vehicle. The tool retainer has a tool receiving space and a resiliently movable tool engaging structure providing a tool engaging surface. The tool and the tool retainer enable the tool to be mounted to the tool retainer by moving the tool in the longitudinal direction into the tool receiving space. The tool contacts the tool engaging structure and urges the tool engaging structure against the resiliency thereof to accommodate ingress of the tool into the tool receiving space. The tool engaging structure thereafter forcibly engages the tool engaging surface against an exterior surface of the tool to frictionally inhibit movement of the tool in the longitudinal direction thereof.

60 Claims, 12 Drawing Sheets

LONGITUDINAL ENTRY CLIP FOR USE IN A VEHICLE JACK SYSTEM AND A VEHICLE JACK SYSTEM INCORPORATING THE SAME

FIELD OF THE INVENTION

The present invention relates a vehicle jack system for installation in a motor vehicle and more particularly to a jack operating tool retainer for securing a vehicle jack operating tool.

BACKGROUND OF THE INVENTION

Vehicle jacks are normally stored within a vehicle for use during emergencies wherein raising and lowering a vehicle is required, such as changing a flat tire. In many vehicles, particularly trucks and sport utilities, the vehicle lift point is spaced underneath the vehicle at a position where elongated jack tools are needed to reach and operate the jack. Due to size restraints within the interior of a vehicle, the jack tools are normally detached from the jack and are coupled to the jack when needed. Oftentimes, the jack and accompanying tools are mounted to a mounting structure, such as a stamped or molded bracket, which is fixed inside the vehicle so that the jack and tools are easily locatable and do not move about while driving.

The jack tools of the type herein contemplated are typically elongated tubes including end portions which are designed to engage the jack and/or accompanying tools for operating the jack. A known system for securing the jack tools comprises a tool clip, shown generally in FIG. 1 at 10, having a base portion, indicated generally at 12, connected to a vehicle mounting structure and opposing resilient leg portions 14, 16 spaced apart from one another. Each leg portion 14, 16 includes a cam portion, shown at 18, 20 respectively, that extends generally outwardly therefrom. The clip 10 is approximately 65% closed. A pair of aligned clips 10 is generally used for securing each tool to the mounting structure.

As shown in FIG. 2, the method for securing the jack tool into these known clips 10 is to first laterally align the tool between the leg portions 14, 16 of a pair of clips 10 and then move the tool between the leg portions 14, 16 of the clips 10. As the tool is moved between the leg portions 14, 16, the exterior surface of the tool engages the cam portions 18, 20 so as to flex the resilient leg portions 14, 16 outwardly away from one another (shown in FIG. 3), thereby allowing the tool to move into its stored position within the clip. Thereafter, the leg portions 14, 16 resiliently return inwardly toward one another with a snap-action to secure the tool in the stored position. The tool can be removed by pulling in an opposite direction to flex out the leg portions 14, 16 so as to withdraw the tool from the clip 10.

The problem with this method is that securing the tool to the clip requires sufficient space to accommodate the positioning of the tool and its movement into the clip. Therefore, this method is not suitable for tight locations within the vehicle, such as underneath or behind a seat, which lacks the necessary space for maneuvering the tool into a secured position within the clips 10.

There is a need for providing a storage system that can be mounted in confined locations and still enable access to the jack tools. Therefore, the limited access areas within the vehicle can be utilized.

SUMMARY OF THE INVENTION

It is an object of the present invention to meet the above-described need. In accordance with the principles of the present invention, this objective is achieved by providing a combination for use with a vehicle jack which is constructed and arranged to be positioned underneath a motor vehicle and then moved through raising and lowering movements under a transmittal of force thereto to affect raising and lowering movements of the vehicle. The combination comprises an elongated rigid jack operating tool which has an exterior surface and a pair of opposing end portions that are spaced apart in a longitudinal direction. At least one of the end portions is constructed and arranged to be coupled in force transmitting relation with the vehicle jack such that moving the tool transmits force to the jack to move the jack through the aforesaid raising and lowering movements. A longitudinal entry tool retainer is constructed and arranged to be fixedly mounted to the vehicle and has a tool receiving space and a resiliently movable tool engaging structure that provides a tool engaging surface. The tool and the tool retainer are constructed and arranged to enable the tool to be mounted to the tool retainer by moving the tool in the longitudinal direction into the tool receiving space. The tool contacts the tool engaging structure and urges the tool engaging structure against the resiliency thereof to accommodate ingress of the tool into the tool receiving space. The tool engaging structure thereafter forcibly engages the tool engaging surface thereof against the exterior surface of the tool to frictionally inhibit movement of the tool in the longitudinal direction thereof.

It is contemplated that the vehicle jack may be included with the above-described combination to provide a vehicle jack system. The jack is removably mounted to the vehicle to enable the jack to be removed therefrom for use in affecting the raising and lowering movements of the vehicle.

In another aspect of the principles of the present invention, the objective is also achieved by providing a method for storing the jack operating tool for use with the vehicle jack. The method comprises providing the elongated rigid jack operating tool and the jack operating tool retainer, moving the tool in the longitudinal direction thereof into the tool receiving space, and fixedly mounting the tool retainer to the vehicle.

These and other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1:
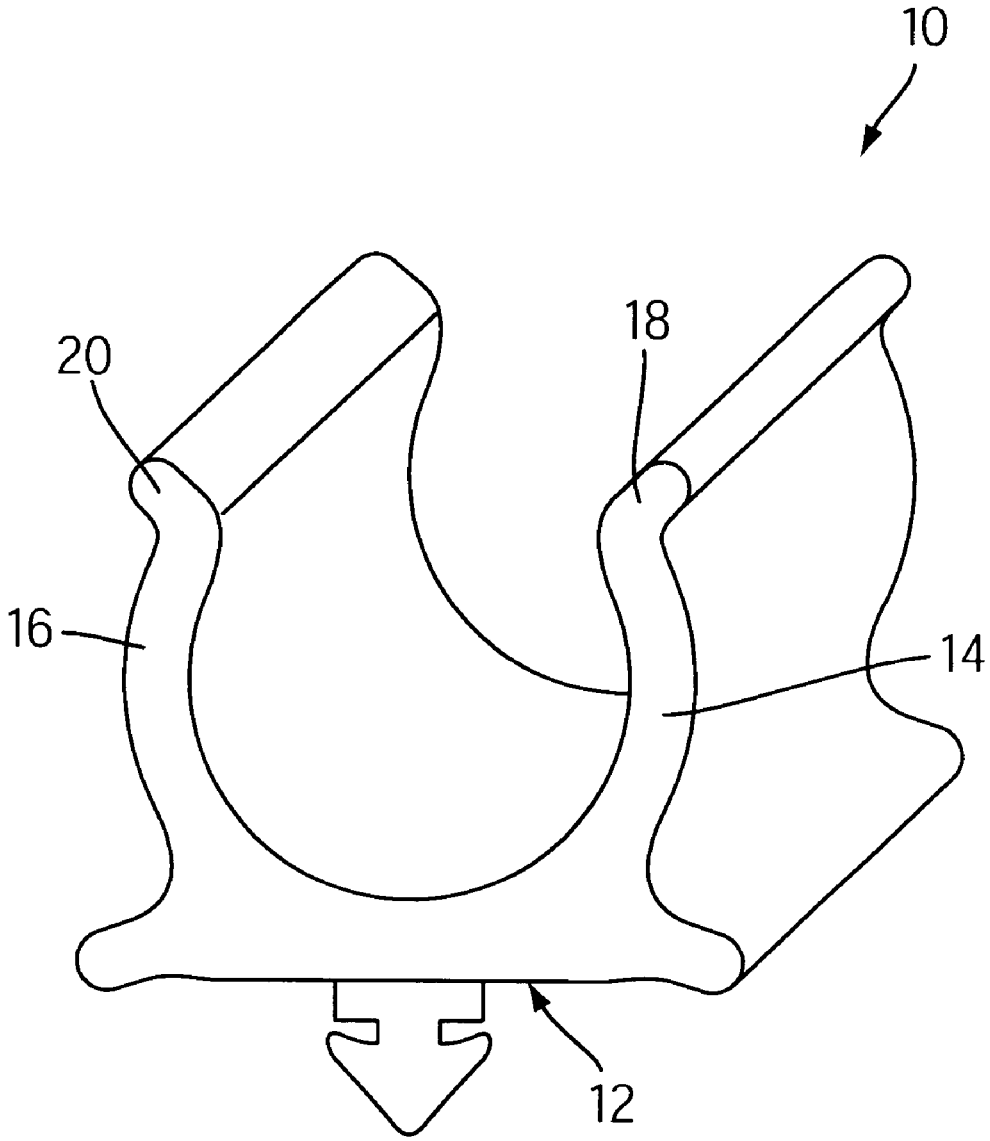
FIG. 1 (PRIOR ART)
FIG. 1 is a perspective view of a jack tool clip used in prior art storage systems.
Figure 2A:
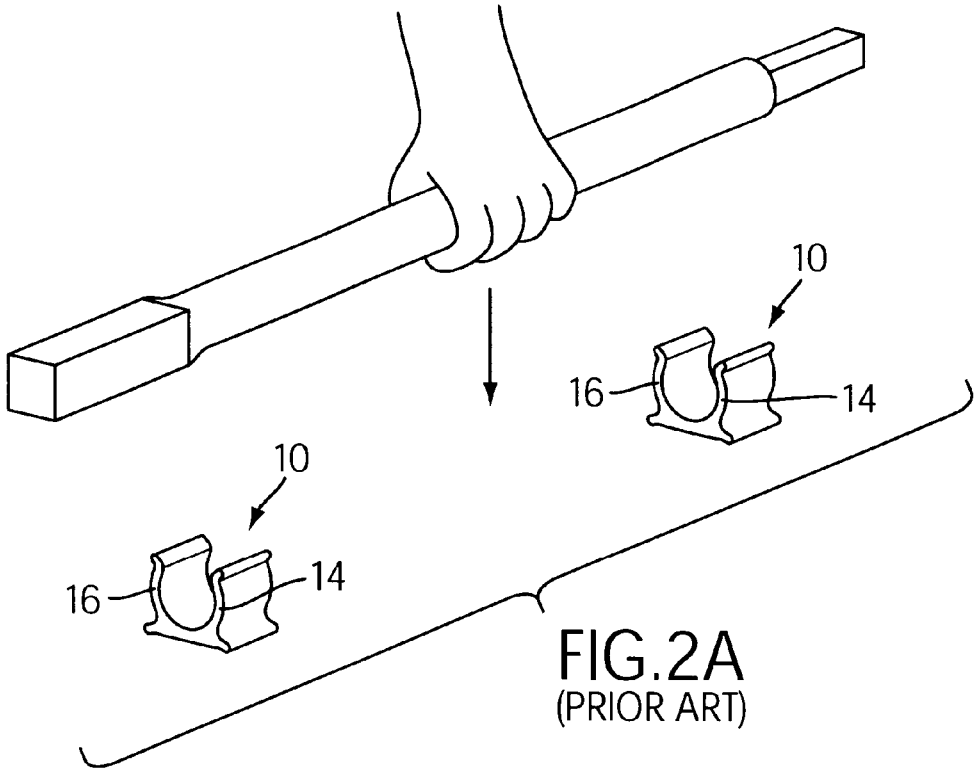
FIG.2A (PRIOR ART)
FIG. 2 is a sequential view showing the method of securing the jack tool into the prior art tool clips.
Figure 2B:
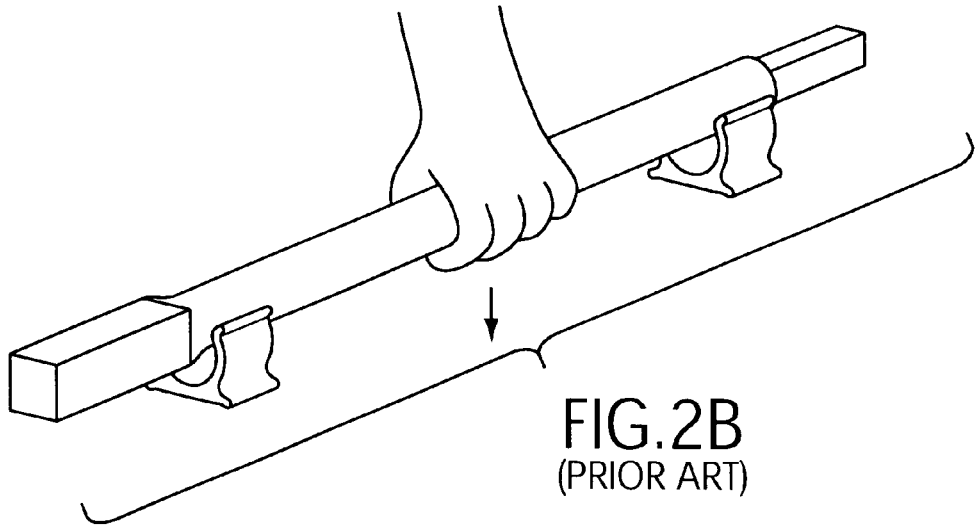
FIG.2B (PRIOR ART)
Figure 3:
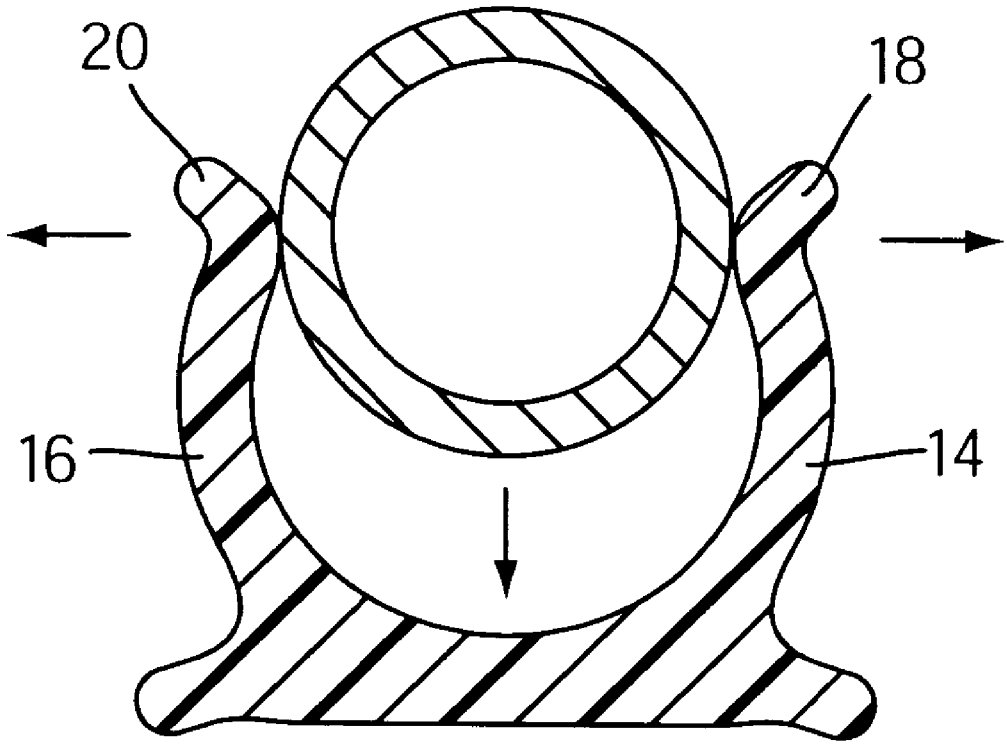
FIG. 3 (PRIOR ART)
FIG. 3 is a cross-sectional view of the jack tool engaging the prior art tool clip.
Figure 4:
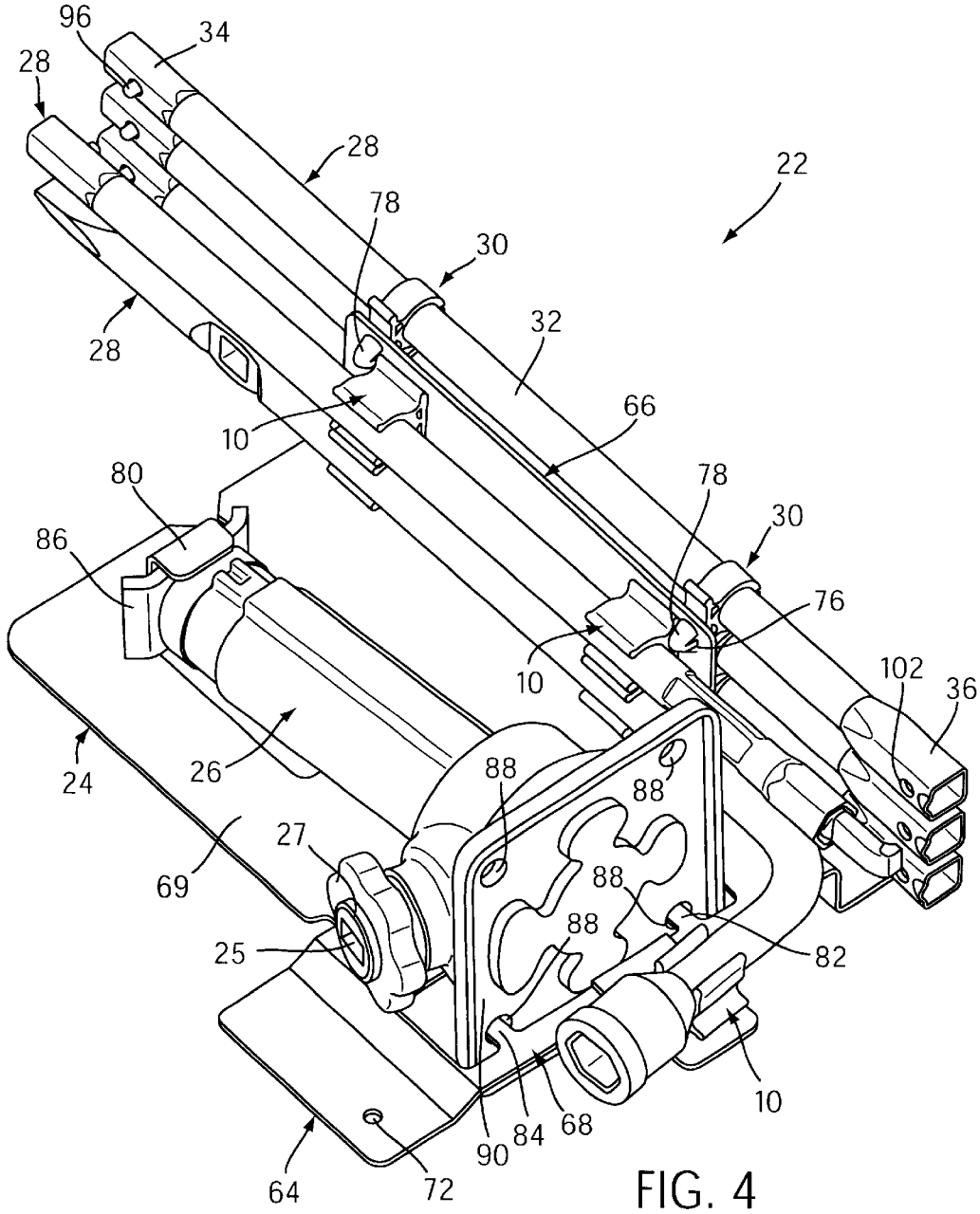
FIG. 4 is a perspective view of a vehicle jack system constructed in accordance with the principles of the present invention.
Figure 5:
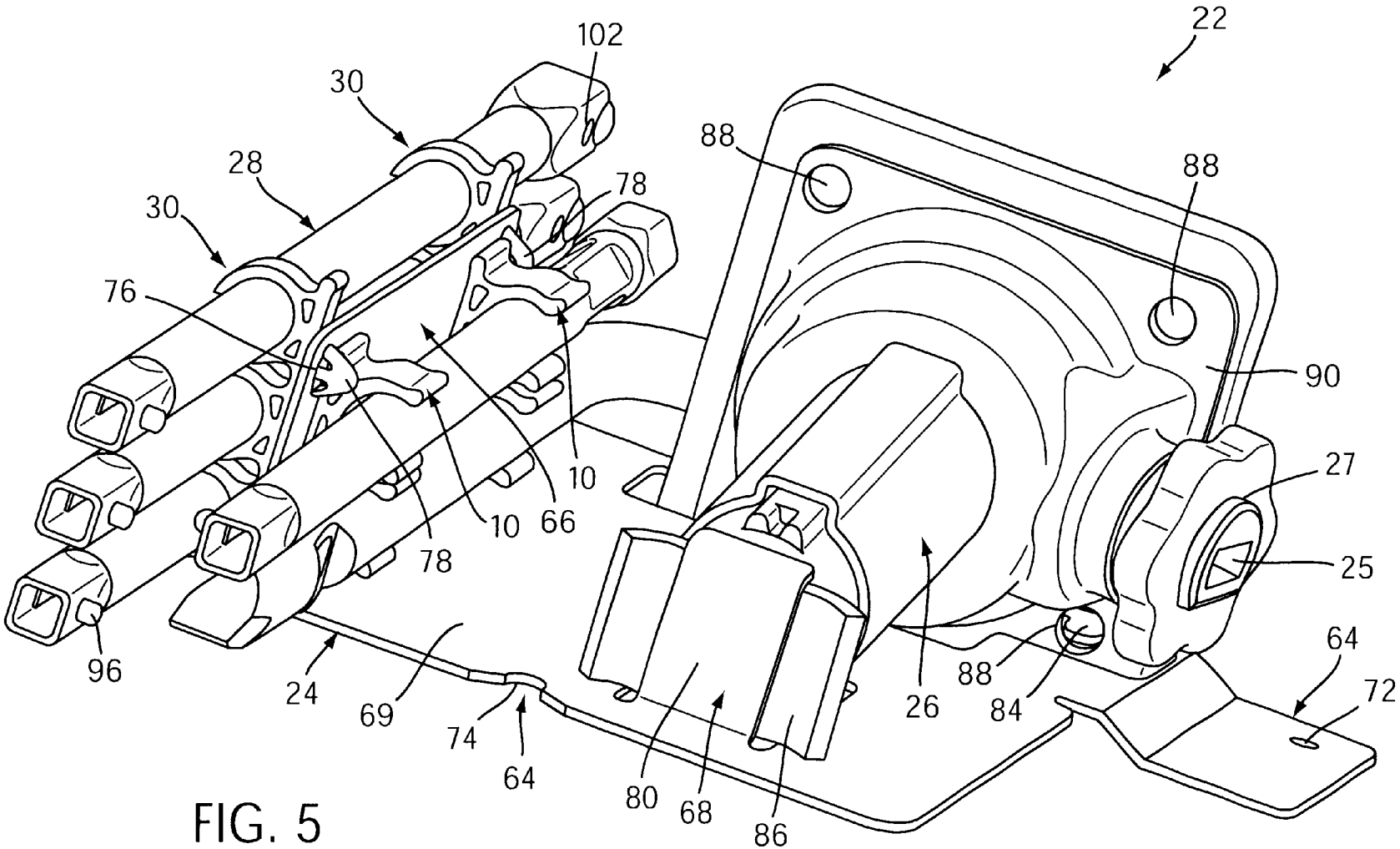
FIG. 5 is another perspective view of the vehicle jack system of FIG. 4.
Figure 6:
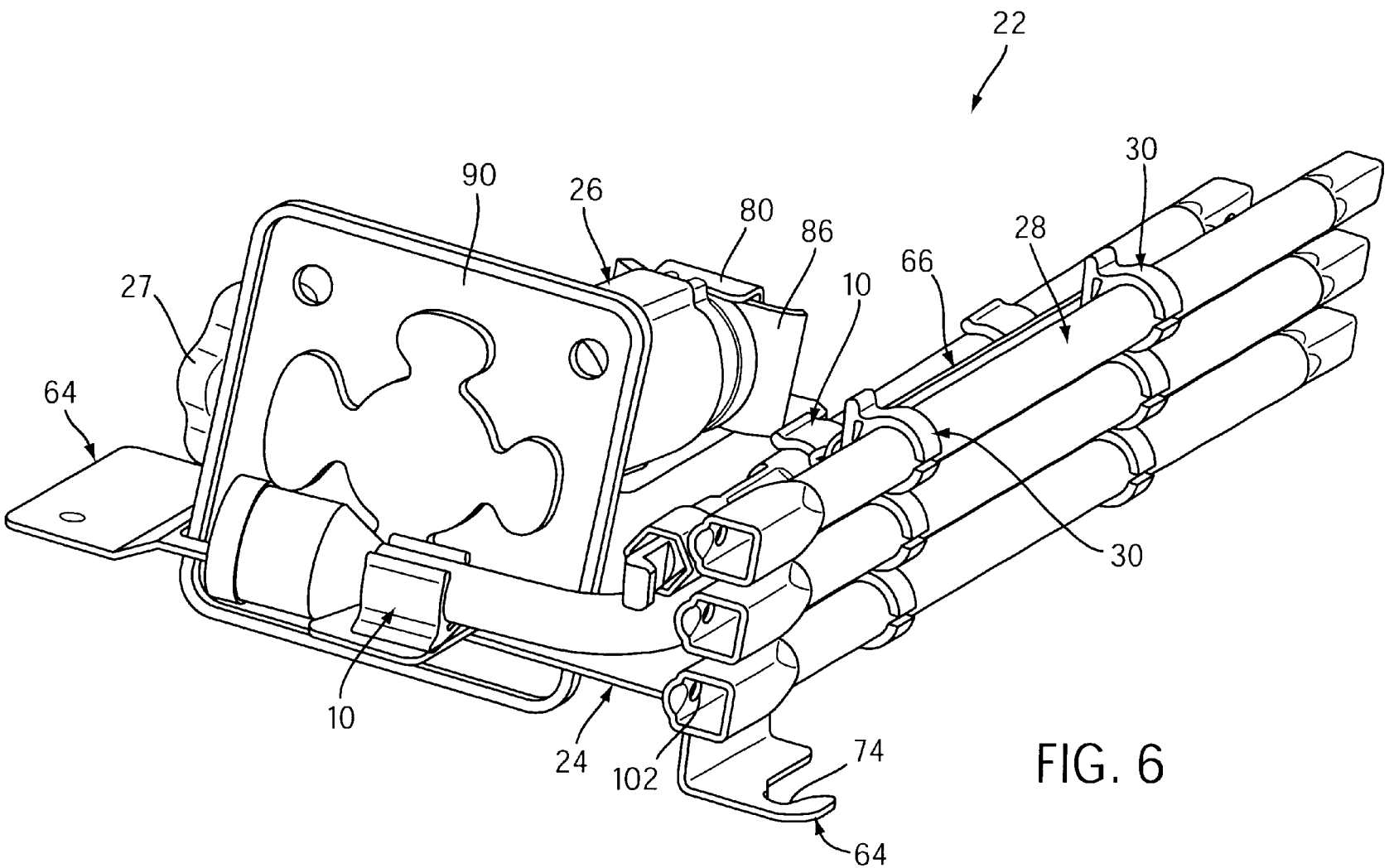
FIG. 6 is another perspective view of the vehicle jack system of FIG. 4.

FIGS. 4–6 show a vehicle jack system, generally indicated at 22, for installation in a motor vehicle, which system embodies the principles of the present invention. The system 22 comprises a mounting bracket, generally indicated at 24, which is constructed and arranged to be fixedly mounted to the vehicle, a vehicle jack, generally indicated at 26, a plurality of elongated rigid jack operating tools, each generally indicated at 28, and a plurality of jack operating tool retainers in the form of longitudinal entry tool retaining clips, each generally indicated at 30.

The vehicle jack 26 is constructed and arranged to be positioned underneath the vehicle and then moved through raising and lowering movements under a transmittal of force thereto to affect raising and lowering movements of the vehicle. The jack 26 shown is a mechanical screw jack, although other jacks such as pantograph and half-scissor jacks are also contemplated. The specific type of jack used is not important to the present invention and any type of jack may be used. The jack 26 is removably mounted to the mounting bracket 24 to enable the jack 26 to be removed therefrom for use in affecting the raising and lowering movements of the vehicle as aforesaid.

Each tool 28 has an exterior surface 32 and a pair of opposing end portions 34, 36 spaced apart in a longitudinal direction. Each tool 28 is tubular (although they may be solid throughout) and may be generally straight along its entire longitudinal extent or bent at a point intermediate the opposing end portions 34, 36. At least one of the end portions 34, 36 is coupled in force transmitting relation with the vehicle jack 26 such that moving the tool 28 transmits force to the jack 26 to move the jack 26 through the aforesaid raising and lowering movements. Specifically, to operate the jack 26 the user inserts end portion 34 of the jack tool 28 into a tool receiving slot 25 of a jack input structure 27 of the jack 26 and rotates the jack tool 28 so as to rotate the jack input structure 27. The jack 26 converts the torque or force applied to the input structure 27 into raising and lowering movements of a vehicle engaging portion 86.

Figure 7:
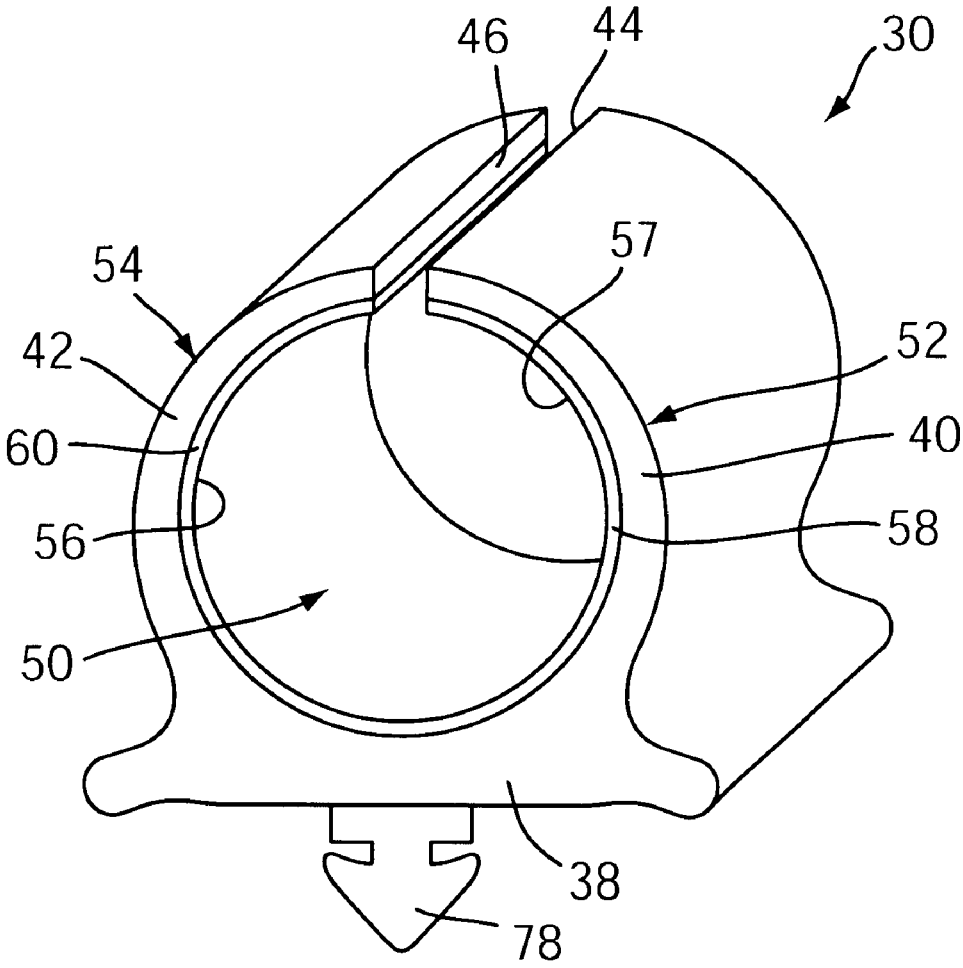
FIG. 7 is a perspective view of a tool retaining clip constructed in accordance with the principles of the present invention.

FIG. 7 illustrates an exemplary clip 30 constructed in accordance with the principles of the present invention. The clip 30 has a base portion 38 that fixedly mounts to the mounting bracket 24. Each clip 30 includes a pair of opposing leg portions 40, 42 with free ends 44, 46 spaced apart from one another. The leg portions 40, 42 and the base portion 38 have interior surfaces that define a tool receiving space, generally shown at 50, for each clip 30. The leg portions 40, 42 provide a pair of resiliently movable tool engaging structure, generally shown at 52, 54. These tool engaging structures 52, 54 respectively provide a pair of tool engaging surfaces 56, 57. The tool engaging structures 52, 54 are resiliently movable apart from one another and have chamfered engageable edge surfaces 58, 60. The edge surfaces 58, 60 could also be rounded. Each clip 30 is preferably molded from plastic.

Each tool 28 is removably mounted to the mounting bracket 24 by being removably received in the tool receiving spaces 50 of a pair of aligned clips 30. The tool engaging structures 52, 54 of each clip 30 forcibly engage the tool engaging surfaces 56, 57 thereof against the exterior surface 32 of each tool 28 to frictionally inhibit movement of each tool 28 in the longitudinal direction thereof. Each tool 28 and its associated clips 30 are constructed and arranged to enable each tool 28 to be removed for coupling to the jack 26 in force transmitting relation by moving each tool 28 in the longitudinal direction thereof so as to longitudinally withdraw each tool 28 from the tool receiving spaces 50 of a pair of aligned clips 30.

Figure 8:
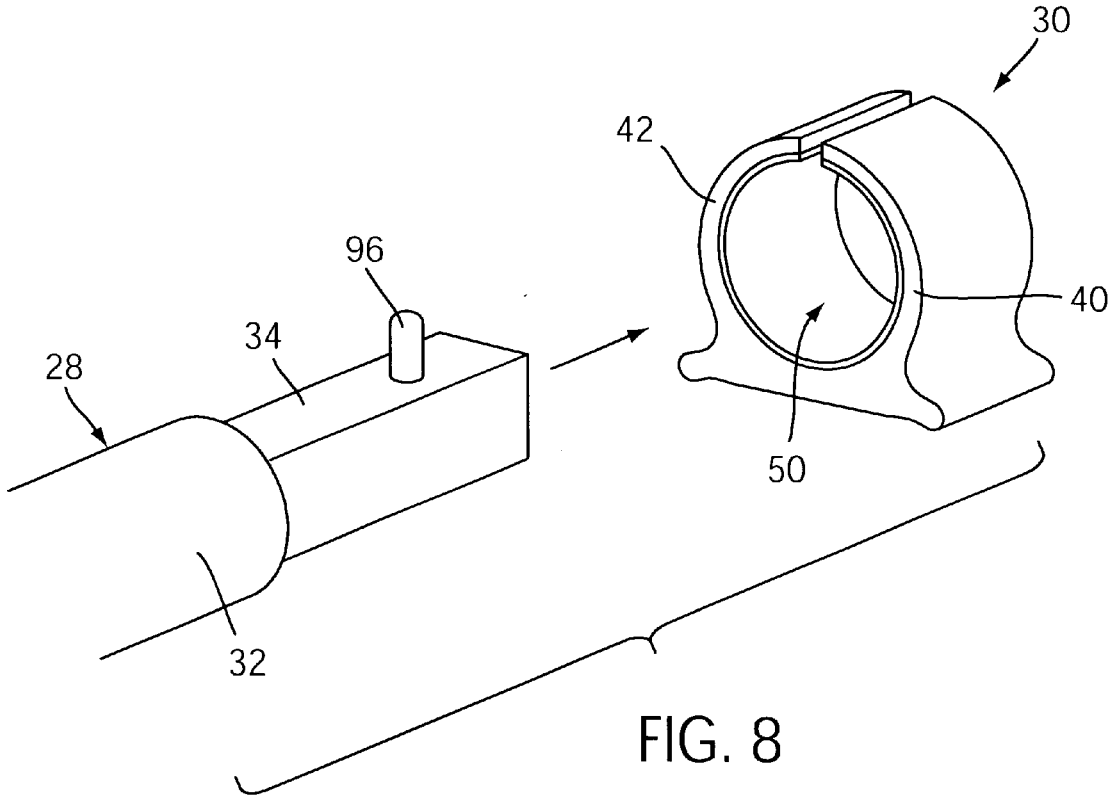
FIG. 8 is a perspective view showing a tool being mounted to the clip of FIG. 7.

Each tool 28 and its associated clips 30 are also constructed and arranged to enable each tool 28 to be re-mounted to the clips 30 by moving each tool 28 in the longitudinal direction thereof into the tool receiving space 50, as shown in FIG. 8. As the tool 28 moves into the tool receiving space 50 of an associated clip 30, the tool 28 engages against the chamfered edge surfaces 58, 60 of the tool engaging structures 52, 54 in a camming action so as to move the tool engaging structures 52, 54 apart from one another against the resiliency thereof to accommodate ingress of the tool 28 within the tool receiving space 50. The tool engaging structures 52, 54 thereafter move inwardly under their own resiliency to forcibly engage the tool engaging surfaces 56, 57 against the exterior surface 32 of the tool 28 to frictionally inhibit movement of the tool 28 in the longitudinal direction thereof as mentioned above.

Figure 9:
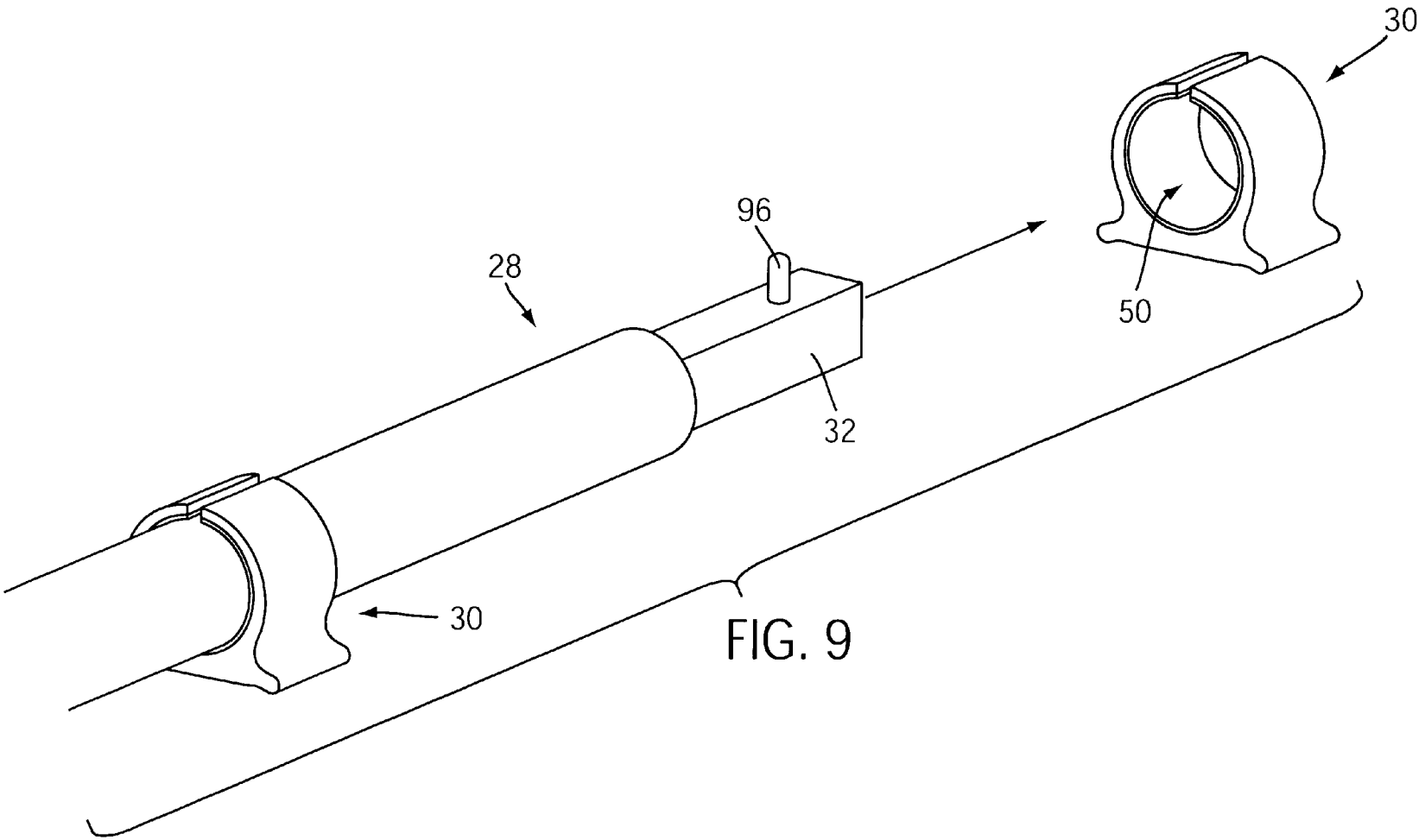
FIG. 9 is a perspective view showing a tool being mounted to aligned first and second clips.

The tool 28 is mounted to the aligned second clip 30 after mounting the tool 28 to the first clip 30 as aforesaid by continuing to move the tool 28 in the longitudinal direction thereof into the tool receiving space 50 of the second clip 30, shown in FIG. 9. As with the first clip 30, the tool 28 contacts the tool engaging structure 52, 54 of the second clip 30 and urges the tool engaging structure 52, 54 of the second clip 30 against the resiliency thereof to accommodate ingress of the tool 28 into the tool receiving space 50. The tool engaging structure 52, 54 of the second clip 30 thereafter forcibly engages the tool engaging surfaces 56, 57 thereof against the exterior surface 32 of the tool 28 to frictionally inhibit movement of the tool 28 in the longitudinal direction thereof in cooperation with the tool engaging surface 56 of the first clip 30.

In each clip 30, a small gap is provided between the free ends 44, 46 of the leg portions 40, 42. With this gap, the leg portions 40, 42 can flex outwardly as needed to adjust to tools 28 of varying size. If the clip 30 were fully enclosed, a clip diameter must be selected so the tool 28 will be able to slide in. The clip diameter must also be sufficiently close to the tool diameter to provide sufficient frictional interference to secure the tool 28 in place. Due to the close tolerance factors that a fully enclosed clip would require, it is preferred that each clip 30 include a small gap.

The mounting bracket 24 is stamped from a piece of sheet metal and deformed in a conventional manner to provide a plurality of vehicle mounting portions, each generally indicated at 64, a clip mounting portion, generally indicated at 66, a jack mounting portion, generally indicated at 68, and a planar base 69. The clip mounting portion 66 extends upwardly from the bracket 24 and may be integral to the bracket 24 or mounted separately by welding, for example.

The vehicle mounting portions 64 are in the form of integral or separately formed flat tabs that extend from the base 69 and each have a fastener receiving space in the form of generally circular hole 72 bored therethrough or a partially circular recess 74 formed from the edge thereof. Fasteners, such as bolts, are inserted through the holes 72 and recesses 74 to secure the mounting bracket 24 to the vehicle. Alternatively, these holes 72 and recesses 74 may be omitted and the bracket 24 may be mounted by welding or in any other suitable manner.

The clip mounting portion 66 has a plurality of generally circular holes 76 bored therethrough. The base portion 38 of each clip 30 has a locking portion 78 which is constructed and arranged to be inserted through the hole 76 with a snap-action to secure the clip 30 to the clip mounting portions 66, 70.

The jack mounting portion 68 includes a support member 80 and a pair of locking tab members 82, 84. To secure the jack 26, a base portion 90 of the jack 26 has holes 88 bored therethrough which allow the tab members 82, 84 to pass therethrough. The jack 26 is engaged with the tab members 82, 84 at an angle outwardly from the bracket 24 and then pivoted downwardly until the vehicle engaging portion 86 can be positioned within the support member 80. Thus, the jack 26 is releasably secured between the support member 80 and the tab members 82, 84 of the jack mounting portion 68. To release the jack 26, the jack 26 is forced in the direction of the tab members 82, 84 until the engaging portion 86 clears the support member 80. Then, the jack 26 is pivoted outwardly from the bracket 24 and removed out from the tab members 82, 84.

The illustrated embodiment shows a combination clip structure that comprises three integral clips 30 including three pairs of leg portions 40, 42, a common base portion 38, and two locking portions 78 that secure each combination clip structure to the mounting bracket 24. It is contemplated that any number of clips 30 may be combined into a combination clip structure or that the clip 30 may be configured as in FIG. 7 including one pair of leg portions 40, 42 secured separately to the mounting bracket 24 by a single locking portion 78 of the base portion 38. It is also contemplated that any number of aligned clips 30 may be used to secure each tool 28. The illustrated embodiment shows two aligned clips 30 securing each tool 28, but one clip 30 or more than two clips 30 could be used.

Figure 10:
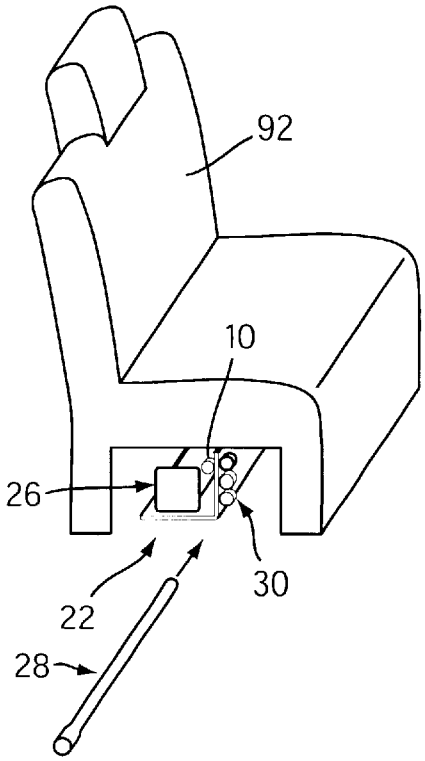
FIG. 10 is a perspective view showing a tool being mounted to a vehicle jack system that is mounted underneath a vehicle seat.

The embodiment also shows that the clips 10 of the prior art are also utilized along with the clips 30 of the present invention. Depending on the access area in which the system 22 is mounted, different clip combinations may be used. The illustrated embodiment of the system 22 may be mounted under a seat 92 towards the front portion thereof as shown in FIG. 10. In that arrangement, the jack 26 and the jack tools 28 on a rearward side of the clip mounting portion 66 would be accessible in the rear portion under the seat 92 such that there is sufficient space to accommodate lateral movement of the jack tools 28 into prior art lateral entry clips 10; but access to the front portion under the seat 92 is quite limited and the longitudinal entry clips 30 of the present invention must be used. It is preferable that the longitudinal entry clips 30 are oriented towards the front of the vehicle, in the arrangement illustrated in FIG. 10, because the generally enclosed configuration of the longitudinal entry clips 30 prevents lateral movement of the jack tools 28 that may occur during operation of the vehicle.

It is contemplated that the clips 10, 30 and the mounting bracket 24 may be integrally molded to provide a one piece construction.

It is further contemplated that the clips 10, 30 are mounted on the jack 26, with the jack 26 being mountable to the mounting bracket 24. Thus, the jack tools 28 may be mounted to the jack 26 prior to mounting the jack 26 to the bracket 24. Likewise, the jack tools 28 may be removed from the jack 26 following the removal of the jack 26 from the bracket 24.

Figure 11:
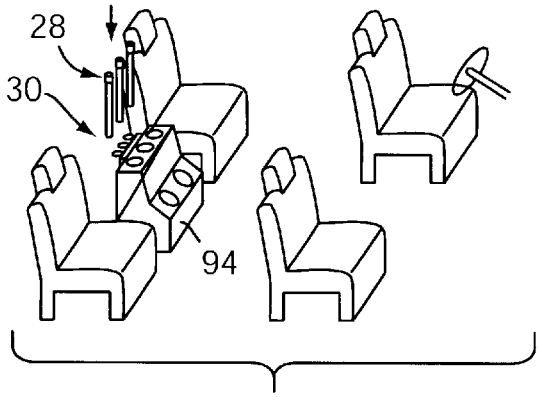
FIG. 11 is a perspective view showing a tool being mounted to a vehicle jack system that is mounted behind a vehicle console.
Figure 12:
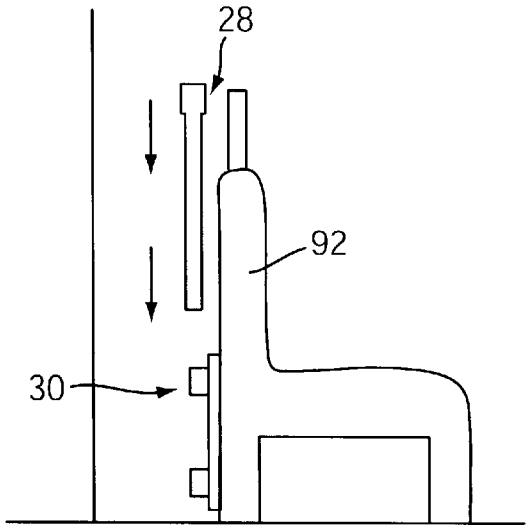
FIG. 12 is a side view showing a tool being mounted to a vehicle jack system that is mounted behind a vehicle seat.

FIGS. 11–12 also show other mounting situations in which the longitudinal entry clips 30 of the present invention are preferably utilized, such as behind a console 94, behind seats 92, and other such areas where the tools 28 cannot be moved laterally into the clips 30.

Figure 13:
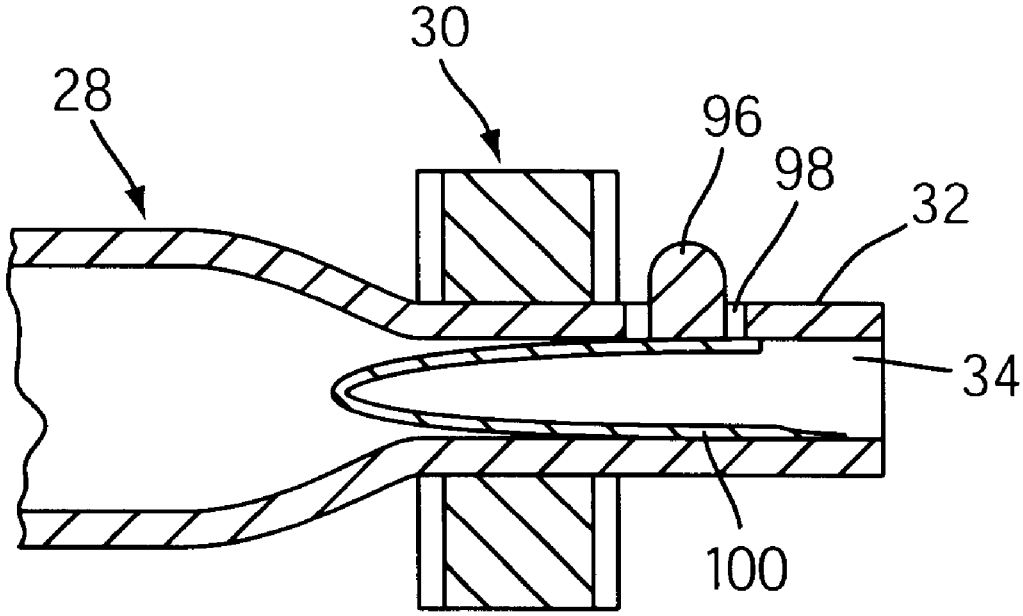
FIG. 13 is a cross-sectional view showing a tool including a lock button that is mounted to a clip.

Referring more particularly to FIG. 13, the Figure shows that one of the opposing end portions 34 of the tool 28 has a lock button 96 extending through an opening 98 formed in the exterior surface 32 of the tool 28 and a leaf spring 100 mounted within the tool 28 adjacent the opening 98. The lock button 96 is mounted to the spring 100 such that the spring 100 biases the lock button 96 outwardly through the opening 98 to a locking position.

The clip 30 enables one end portion 34 of the tool 28 having the lock button 96 to move into the tool receiving space 50. The lock button 96 engages the clip 30 in a camming action to urge the lock button 96 inwardly from the locking position thereof to permit ingress of the tool 28 into the tool receiving space 50. As the tool 28 is moved longitudinally into the clip 30, the lock button 96 engages the chamfered edge surfaces 58, 60 in a camming action to force the lock button 96 down. After the lock button 96 has moved through the tool receiving space 50 and beyond the tool engaging structures 52, 54, the lock button 96 returns to the locking position thereof under the biasing of the spring 100 so that the lock button 96 can engage the clip 30 to inhibit removal of the tool 28 in the longitudinal direction thereof from the tool receiving space 50 until the tool 28 is withdrawn with sufficient force to cam the lock button back down to its releasing position.

The lock button 96 also enables two or more tools 28 to be connected together in a locking manner to operate the jack 26. The tool 28 includes a hole 102 formed in the exterior surface 32 of an other opposing end portion 36 that can receive the lock button 96 of an other tool as it is engaged therein and inhibit removal therefrom. An end portion 34 of the elongated connected tools 28 is slotably connected within the tool receiving slot 25 of the jack 26 which has a similar cross-section to that of the end portion 34. A bent tool 28 is attached to the other end of the elongated connected tools 28 to facilitate the rotation of the elongated connected tools 28 which transmits the force to the jack 26 to move the jack 26 through the aforesaid raising and lowering movements.

The lock button 96 is not a necessary feature for retaining the tools 28 to the clip 30. In place of the lock button 96 for coupling the tool 28 to another tool 28 or jack 26, other ways such as threadably engaged or friction fitted may be used.

Figure 14:
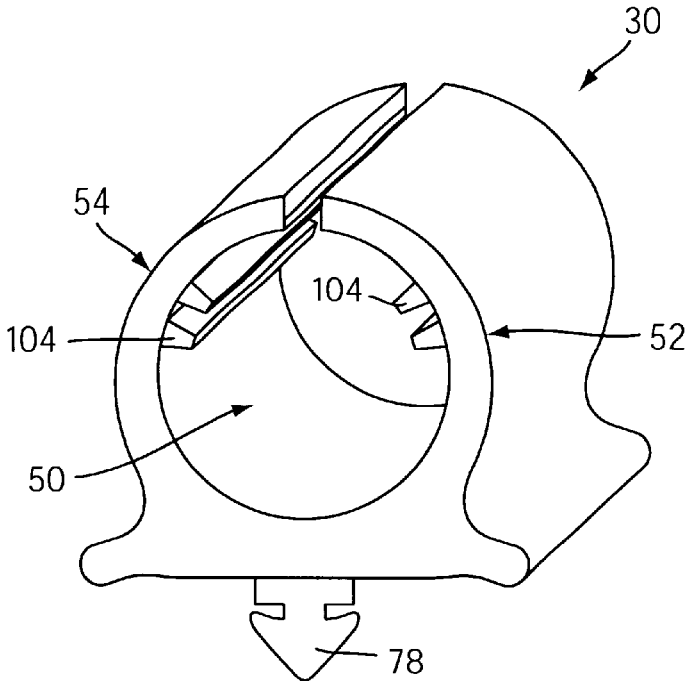
FIG. 14 is a perspective view showing an alternative clip that includes deformable ribs.

FIG. 14 shows an alternative construction for the longitudinal entry tool retainer having a plurality of tool engaging structures 52, 54 provided by a plurality of deformable ribs 104 that extend into the tool receiving space 50. These ribs 104 will bend to accommodate the tool 28 and forcibly engage the exterior surface 32 of the tool 28 to inhibit longitudinal removal thereof.

Figure 15:
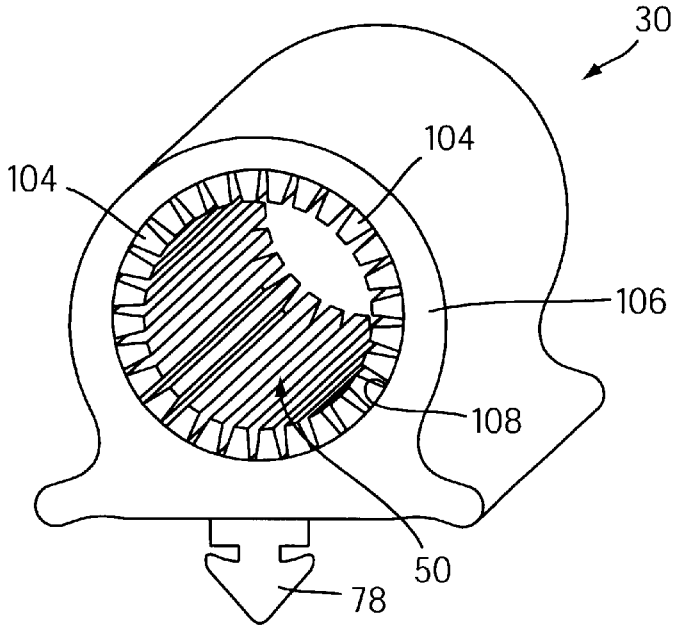
FIG. 15 is a perspective view showing an alternative clip that includes an annular wall with deformable ribs.

FIG. 15 shows another alternative construction for the longitudinal entry tool retainer. In this embodiment, the clip 30 includes an annular wall 106 surrounding the tool receiving space 50 wherein the deformable ribs 104 in FIG. 14 are provided along the entire periphery of an interior surface 108 of the wall 106.

The jack 26 does not necessarily have to be included with the system 22 thus the invention may encompass the basic combination of the tool 28 and the tool retaining clip 30 (the jack 26 may be acquired separately to use with this combination) or the full jack system including the jack and the mounting structure.

The invention also encompasses a method for storing the jack operating tool 28 for use with the vehicle jack 26. This method comprises providing the elongated rigid jack operating tool 28 having the exterior surface 32 and the pair of opposing end portions 34, 36 spaced apart in a longitudinal direction thereof. At least one of the end portions 34, 36 is constructed and arranged to be coupled in force transmitting relation with the vehicle jack 26 such that moving the jack operating tool 28 transmits force to the jack 26 to move the jack through the raising and lowering movements thereof. The longitudinal entry tool retainer 30 is provided which is constructed and arranged to be fixedly mounted to the vehicle. The tool retainer 30 has the tool receiving space 50 and resiliently movable tool engaging structures 52, 54 providing the tool engaging surfaces 56, 58. The tool 28 is moved in the longitudinal direction thereof into the tool receiving space 50 such that the tool 28 contacts the tool engaging structures 52, 54 and urges the tool engaging structures 52, 54 against the resiliency thereof to accommodate ingress of the jack tool 28 into the tool receiving space 50. The tool engaging structures 52, 54 thereafter forcibly engages the tool engaging surfaces 56, 58 against the exterior surface 32 of the tool 28 to frictionally inhibit movement of the tool 28 in the longitudinal direction thereof. Then, the tool retainer 30 is fixedly mounted to the vehicle.

It is contemplated that this method may comprise any number of aligned tool retainers 30 to secure each tool 28 including a single retainer. It is also contemplated that the tool retainer 30 be fixedly mounted before or after moving the tool 28 in the longitudinal direction thereof into the tool receiving space 50.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A combination for use with a vehicle jack constructed and arranged to be positioned underneath a motor vehicle and then moved through raising and lowering movements under a transmittal of force thereto to affect raising and lowering movements of the vehicle, said combination comprising:

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer constructed and arranged to be fixedly mounted to the vehicle, said tool retainer having a tool receiving space and resiliently movable tool engaging structure providing a tool engaging surface facing into the tool receiving space, the resiliently movable tool engaging structure also providing a cam surface;

said tool and said tool retainer being constructed and arranged to enable said tool to be mounted to said tool retainer by moving said tool in the longitudinal direction thereof into said tool receiving space such that said tool contacts the cam surface of said tool engaging structure and cams the cam surface to urge said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof.

2. A combination according to claim 1, wherein said tool retainer is a tool retaining clip having a base portion constructed and arranged to be fixedly mounted to the vehicle and a pair of opposing leg portions with free ends spaced apart from one another, said leg portions and said base portion having interior surfaces defining said tool receiving space of said tool retaining clip, said tool engaging structure being provided by said leg portions, said tool engaging surfaces being provided by said interior surfaces of said tool retaining clips, and said cam surface being provided by engageable edge surfaces of the leg portions, said leg portions being resiliently movable apart from one another, said engageable edge surfaces of said tool engaging structure being configured such that movement of said tool in the longitudinal direction thereof into said tool receiving space engages said tool against said edge surfaces in a camming action so as to move said leg portions apart from one another against the resiliency thereof to accommodate ingress of said tool within said tool receiving space and such that said leg portions thereafter forceably engage said interior surfaces thereof against the exterior surface of said tool to frictionally inhibit movement of the tool in the longitudinal direction thereof.

3. A combination according to claim 1, wherein said tool retainer is a first longitudinal entry tool retainer and wherein said system further comprises:

a second longitudinal entry tool retainer having a tool receiving space and resiliently movable tool engaging structure providing a tool engaging surface facing into the tool receiving space, the resiliently movable tool engaging structure of the second tool retainer also providing a cam surface, said second tool retainer being constructed and arranged to be fixedly mounted to the vehicle in spaced apart relation from said first tool retainer with said tool receiving spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said tool receiving space of said second tool retainer such that (a) said tool contacts the cam surface of said tool engaging structure of said second tool retainer and cams the cam surface to urge said tool engaging structure of said second tool retainer against the resiliency thereof to accommodate ingress of said tool into said tool receiving space and (b) said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of said first tool retainer.

4. A combination according to claim 3, wherein each of said first and second tool retainers is a tool retaining clip having a base portion constructed and arranged to be fixedly mounted to the vehicle and a pair of opposing leg portions with free ends spaced apart from one another, said leg portions and said base portion having interior surfaces defining said tool receiving space of each of said tool retaining clips, said tool engaging structure of each of said tool retaining clips being provided by said leg portions, said tool engaging surfaces of each of said tool retaining clips being provided by said interior surfaces of said tool retaining clips and said cam surfaces of said tool retaining clips being provided by engageable edge surfaces of the leg portions, said leg portions of each of said tool retaining clips being resiliently movable apart from one another;

said engageable edge surfaces of said tool engaging structure of each tool retaining clip being configured such that movement of said tool in the longitudinal direction thereof into said tool receiving space of each clip engages said jack tool against said edge surfaces thereof in a camming action so as to move said leg portions thereof apart from one another against the resiliency thereof to accommodate ingress of said tool within said tool receiving space thereof and such that said leg portions thereafter forceably engage said interior surfaces thereof against the exterior surface of said tool to frictionally inhibit movement of the jack tool in the longitudinal direction thereof.

5. A combination according to claim 4, wherein said clips are molded from plastic.

6. A combination according to claim 4, further comprising a mounting bracket constructed and arranged to be mounted to the vehicle, said first and second tool retaining clips being fixedly mounted to said mounting bracket for fixed mounting to the vehicle with said tool receiving spaces thereof generally aligned with one another.

7. A combination according to claim 1, wherein said tool is tubular.

8. A combination according to claim 1, wherein said tool is generally straight along its entire longitudinal extent.

9. A combination according to claim 1, wherein said tool is bent at a point intermediate said opposing end portions thereof.

10. A combination according to claim 2, wherein said engageable edge surfaces of said tool engaging structure of each tool retaining clip are chamfered.

11. A combination according to claim 4, wherein said engageable edge surfaces of said tool engaging structure of said tool retaining clip are chamfered.

12. A combination according to claim 1, wherein said tool receiving space is open to opposing end portions of said tool retainer to enable said tool to be moved therethrough as said tool is being mounted to said tool retainer and wherein said one of said opposing end portions of said tool has a lock button extending through an opening formed in the exterior surface of said tool and a spring mounted within said tool adjacent said opening, said lock button being mounted to said spring such that said spring biases said lock button outwardly through said opening to a locking position, said tool retainer being constructed and arranged such that as said one end portion of said tool having said lock button is moved into said tool receiving space, said lock button engages said cam surface in a camming action to urge said lock button inwardly from the locking position thereof to permit ingress of said tool into said tool receiving space and further such that after said lock button has moved through said tool receiving space and beyond said tool engaging structure said lock button returns to said locking position thereof under the biasing of said spring so that said lock button can engage said tool retainer to inhibit removal of said tool in the longitudinal direction thereof from said tool receiving space.

13. A combination according to claim 12, wherein said tool retainer is a tool retaining clip having a base portion constructed and arranged to be fixedly mounted to the vehicle and a pair of opposing leg portions with free ends spaced apart from one another, said leg portions and said base portion having interior surfaces defining said tool receiving space of said tool retaining clip, said tool engaging structure being provided by said leg portions, said tool engaging surfaces being provided by said interior surfaces of said tool retaining clips, and said cam surface being provided by engageable edge surfaces of the leg portions, said leg portions being resiliently movable apart from one another;

said engageable edge surfaces of said tool engaging structure being configured such that movement of said tool in the longitudinal direction thereof into said tool receiving space (a) engages said tool against said edge surfaces in a camming action so as to move said leg portions apart from one another against the resiliency thereof to accommodate ingress of said tool within said tool receiving space and such that said leg portions thereafter forceably engage said interior surfaces thereof against the exterior surface of said tool to frictionally inhibit movement of the tool in the longitudinal direction thereof and (b) engages said lock button of said tool against one of said edge surfaces in a camming action to urge said lock button inwardly from the locked position thereof to permit ingress of said tool into said tool receiving space.

14. A combination according to claim 12, wherein said tool retainer is a first longitudinal entry tool retainer and wherein said system further comprises:

a second longitudinal entry tool retainer having a tool receiving space and resiliently movable tool engaging structure providing a tool engaging surface facing into the tool receiving space, the resiliently movable tool engaging structure of the second tool retainer also providing a cam surface, said second tool retainer being constructed and arranged to be fixedly mounted to the vehicle in spaced apart relation from said first tool retainer with said tool retaining spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said receiving space of said second tool retainer such that (a) said tool contacts the cam surface of said tool engaging structure of said second tool retainer and cams the cam surface to urge said tool engaging structure of said second tool retainer against the resiliency thereof to accommodate ingress of said tool into said tool receiving space and (b) said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of said first tool retainer;

said second tool retainer being constructed and arranged such that as said one end portion of said tool having said lock button is moved in the longitudinal direction thereof into said tool receiving space of said second tool retainer, said lock button engages said second tool retainer in a camming action to urge said lock button inwardly from the locked position thereof to permit ingress of said tool into said tool receiving space of said second tool retainer and further such that after said lock button has moved through said tool receiving space of said second tool retainer and beyond said tool engaging structure thereof said lock button returns to said locked position thereof under the biasing of said spring so that said lock button can engage said tool retainer to inhibit removal of said tool in the longitudinal direction thereof from said tool receiving space.

15. A combination according to claim 14, wherein each of said first and second tool retainers is a tool retaining clip having a base portion constructed and arranged to be fixedly mounted to the vehicle and a pair of opposing leg portions with free ends spaced apart from one another, said leg portions and said base portion having interior surfaces defining said tool receiving space of each of said tool retaining clips, said tool engaging structure of each of said tool retaining clips being provided by said leg portions, said tool engaging surfaces of each of said tool retaining clips being provided by said interior surfaces of said tool retaining clips, and said cam surfaces of said tool retaining clips being provided by engageable edge surfaces of the leg portions, said leg portions of each of said tool retaining clips being resiliently movable apart from one another;

said engageable edge surfaces of said tool engaging structures of each tool retaining clip being configured such that movement of said tool in the longitudinal direction thereof into said tool receiving space of each clip (a) engages said tool against said edge surfaces thereof in a camming action so as to move said leg portions thereof apart from one another against the resiliency thereof to accommodate ingress of said tool within said tool receiving space thereof and such that said leg portions thereafter forceably engage said interior surfaces thereof against the exterior surface of said tool to frictionally inhibit movement of the tool in the longitudinal direction thereof and (b) engages said lock button of said tool in a camming action to urge said lock button inwardly from the locked position thereof to permit ingress of said tool into said tool receiving space.

16. A combination according to claim 15, wherein said clips are molded from plastic.

17. A combination according to claim 16, further comprising a mounting bracket constructed and arranged to be mounted to the vehicle, said first and second tool retaining clips being fixedly mounted to said mounting bracket for fixed mounting to the vehicle with said tool receiving spaces thereof generally aligned with one another.

18. A combination according to claim 13, wherein said engageable edge surfaces of said tool engaging structure of each tool retaining clip are chamfered.

19. A combination according to claim 15, wherein said engageable edge surfaces of each of said tool engaging structures of said tool retaining clip are chamfered.

20. A combination for use with a vehicle jack constructed and arranged to be positioned underneath a motor vehicle and then moved through raising and lowering movements under a transmittal of force thereto to affect raising and lowering movements of the vehicle, said combination comprising:

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer constructed and arranged to be fixedly mounted to the vehicle, said tool retainer having a tool receiving space and resiliently movable tool engaging structure providing a tool engaging surface;

said tool and said tool retainer being constructed and arranged to enable said tool to be mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool engaging structure includes one or more deformable ribs extending into said tool receiving space.

21. A combination according to claim 20, wherein said tool retainer includes an annular wall surrounding said tool receiving space and wherein said one or more deformable ribs include a plurality of said deformable ribs disposed on an interior surface of said wall.

22. A combination for use with a vehicle jack constructed and arranged to be positioned underneath a motor vehicle and then moved through raising and lowering movements under a transmittal of force thereto to affect raising and lowering movements of the vehicle, said combination comprising:

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer constructed and arranged to be fixedly mounted to the vehicle, said tool retainer having a tool receiving space and resiliently movable tool engaging structure providing a tool engaging surface;

said tool and said tool retainer being constructed and arranged to enable said tool to be mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof, wherein said tool retainer is a first longitudinal entry tool retainer and wherein said system further comprises a second longitudinal entry tool retainer having a tool receiving space and resiliently movable tool engaging structure providing a tool engaging surface, said second tool retainer being constructed and arranged to be fixedly mounted to the vehicle in spaced apart relation from said first tool retainer with said tool receiving spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said tool receiving space of said second tool retainer such that said tool contacts said tool engaging structure of said second tool retainer and urges said tool engaging structure of said second tool retainer against the resiliency thereof to accommodate ingress of said tool into said tool receiving space and such that said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of said first tool retainer;

wherein said tool engaging structure of said first tool retainer includes one or more deformable ribs extending into the tool receiving space of said first tool retainer, and wherein said tool engaging structure of said second tool retainer includes one or more deformable ribs extending into the tool receiving space of said second tool retainer.

23. A combination according to claim 22, wherein said first tool retainer includes an annular wall surrounding said tool receiving space thereof and wherein said one or more deformable ribs of said first tool retainer includes a plurality of said deformable ribs disposed on an interior surface of said wall;

wherein said second tool retainer includes an annular wall surrounding said tool receiving space thereof and wherein said one or more deformable ribs of said second tool retainer includes a plurality of said ribs disposed on an interior surface of said wall.

24. A combination for use with a vehicle jack constructed and arranged to be positioned underneath a motor vehicle and then moved through raising and lowering movements under a transmittal of force thereto to affect raising and lowering movements of the vehicle, said combination comprising:

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer constructed and arranged to be fixedly mounted to the vehicle, said tool retainer having a tool receiving space and resiliently movable tool engaging structure providing a tool engaging surface;

said tool and said tool retainer being constructed and arranged to enable said tool to be mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool receiving space is open to opposing end portions of said tool retainer to enable said tool to be moved therethrough as said tool is being mounted to said tool retainer and wherein said one of said opposing end portions of said tool has a lock button extending through an opening formed in the exterior surface of said tool and a spring mounted within said tool adjacent said opening, said lock button being mounted to said spring such that said spring biases said lock button outwardly through said opening to a locking position, said tool retainer being constructed and arranged such that as said one end portion of said tool having said lock button is moved into said tool receiving space, said lock button engages said tool retainer in a camming action to urge said lock button inwardly from the locking position thereof to permit ingress of said tool into said tool receiving space and further such that after said lock button has moved through said tool receiving space and beyond said tool engaging structure said lock button returns to said locking position thereof under the biasing of said spring so that said lock button can engage said tool retainer to inhibit removal of said tool in the longitudinal direction thereof from said tool receiving space;

wherein said tool engaging structure includes one or more deformable ribs extending into said tool receiving space.

25. A combination according to claim 24, wherein said tool retainer includes an annular wall surrounding said tool receiving space and wherein said one or more deformable ribs include a plurality of said deformable ribs disposed on an interior surface of said wall.

26. A combination for use with a vehicle jack constructed and arranged to be positioned underneath a motor vehicle and then moved through raising and lowering movements under a transmittal of force thereto to affect raising and lowering movements of the vehicle, said combination comprising:

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer constructed and arranged to be fixedly mounted to the vehicle, said tool retainer having a tool receiving space and resiliently movable tool engaging structure providing a tool engaging surface;

said tool and said tool retainer being constructed and arranged to enable said tool to be mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool receiving space is open to opposing end portions of said tool retainer to enable said tool to be moved therethrough as said tool is being mounted to said tool retainer and wherein said one of said opposing end portions of said tool has a lock button extending through an opening formed in the exterior surface of said tool and a spring mounted within said tool adjacent said opening, said lock button being mounted to said spring such that said spring biases said lock button outwardly through said opening to a locking position, said tool retainer being constructed and arranged such that as said one end portion of said tool having said lock button is moved into said tool receiving space, said lock button engages said tool retainer in a camming action to urge said lock button inwardly from the locking position thereof to permit ingress of said tool into said tool receiving space and further such that after said lock button has moved through said tool receiving space and beyond said tool engaging structure said lock button returns to said locking position thereof under the biasing of said spring so that said lock button can engage said tool retainer to inhibit removal of said tool in the longitudinal direction thereof from said tool receiving space;

wherein said tool retainer is a first longitudinal entry tool retainer and wherein said system further comprises:

a second longitudinal entry tool retainer having a tool receiving space and resiliently movable tool engaging structure providing a tool engaging surface, said second tool retainer being constructed and arranged to be fixedly mounted to the vehicle in spaced apart relation from said first tool retainer with said tool retaining spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said receiving space of said second tool retainer such that said tool contacts said tool engaging structure of said second tool retainer and urges said tool engaging structure of said second tool retainer against the resiliency thereof to accommodate ingress of said tool into said tool receiving space and such that said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of said first tool retainer;

said second tool retainer being constructed and arranged such that as said one end portion of said tool having said lock button is moved in the longitudinal direction thereof into said tool receiving space of said second tool retainer, said lock button engages said second tool retainer in a camming action to urge said lock button inwardly from the locked position thereof to permit ingress of said tool into said tool receiving space of said second tool retainer and further such that after said lock button has moved through said tool receiving space of said second tool retainer and beyond said tool engaging structure thereof said lock button returns to said locked position thereof under the biasing of said spring so that said lock button can engage said tool retainer to inhibit removal of said tool in the longitudinal direction thereof from said tool receiving space;

wherein said tool engaging structure of said first tool retainer includes one or more deformable ribs extending into the tool receiving space of said first tool retainer, and wherein said tool engaging structure of said second tool retainer includes one or more deformable ribs extending into the tool receiving space of said second tool retainer.

27. A combination according to claim 26, wherein said first tool retainer includes an annular wall surrounding said tool receiving space thereof and wherein said one or more deformable ribs of said first tool retainer includes a plurality of said deformable ribs disposed on an interior surface of said wall;

wherein said second tool retainer includes an annular wall surrounding said tool receiving space thereof and wherein said one or more deformable ribs of said second tool retainer includes a plurality of said ribs disposed on an interior surface of said wall.

28. A method for storing a jack operating tool for use with a vehicle jack, the vehicle jack being constructed and arranged to be positioned underneath a motor vehicle and moved through raising and lowering movements under a transmittal of force thereto to affect raising and lowering movements of the vehicle, said method comprising:

providing an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the jack operating tool transmits force to the jack to move the jack through the raising and lowering movements thereof;

providing a longitudinal entry tool retainer constructed and arranged to be fixedly mounted to the vehicle, said tool retainer having a tool receiving space and resiliently movable tool engaging structure providing a tool engaging surface;

moving said tool in the longitudinal direction thereof into said tool receiving space such that said tool contacts said tool engaging structure and urges said tool engaging structure against the resiliency thereof to accommodate ingress of said jack tool into said tool receiving space and said tool engaging structure thereafter forceably engages said tool engaging surface against the exterior surface of said tool to frictionally inhibit movement of said tool in the longitudinal direction thereof; and fixedly mounting said tool retainer to the vehicle.

29. A method according to claim 28, wherein fixedly mounting said tool retainer is performed after moving said tool in the longitudinal direction thereof into said tool receiving space.

30. A method according to claim 29, further comprising:

providing a mounting bracket constructed and arranged to be fixedly mounted to the vehicle;

fixedly mounting said tool retainer to said mounting bracket; and after moving said tool in the longitudinal direction thereof into said tool receiving space of said tool retainer, then fixedly mounting said bracket to the vehicle to thereby fixedly mount the tool retainer to the vehicle.

31. A method according to claim 30, wherein said tool is moved in the longitudinal direction thereof into said tool receiving space of said tool retainer after fixedly mounting said tool retainer to said mounting bracket.

32. A method according to claim 28, wherein said tool retainer is a first longitudinal entry tool retainer and wherein said method further comprises:

providing a second longitudinal entry tool retainer having a tool receiving space and resiliently movable tool engaging structure providing a tool engaging surface;

after said tool is moved in the longitudinal direction thereof into said tool receiving space of said first tool retainer, moving said tool in the longitudinal direction thereof into the tool receiving space of said second tool retainer such that said tool contacts said tool engaging structure of said second tool retainer and urges said tool engaging structure against the resiliency thereof to accommodate ingress of said jack tool into said tool receiving space of said second tool retainer and said tool engaging structure thereafter forceably engages said tool engaging surface thereof against the exterior surface of said tool to frictionally inhibit movement of said tool in the longitudinal direction thereof in cooperation with the tool engaging surface of said first tool retainer; and fixedly mounting said second tool retainer to the vehicle.

33. A method according to claim 32, wherein both fixedly mounting said first tool retainer and fixedly mounting said second tool retainer are performed after moving said tool in the longitudinal direction thereof into said tool receiving spaces of said first and second tool retainers.

34. A method according to claim 33, further comprising:

providing a mounting bracket constructed and arranged to be fixedly mounted to the vehicle;

fixedly mounting said first and second tool retainers to said mounting bracket;

after moving said tool in the longitudinal direction into the tool receiving spaces of said first and second tool retainers, fixedly mounting said bracket to the vehicle to thereby fixedly mount said tool retainers to the vehicle.

35. A method according to claim 34, wherein said tool is moved in the longitudinal direction thereof into the tool receiving spaces of said first and second tool retainers after fixedly mounting said first and second tool retainer to said mounting bracket.

36. A vehicle jack system for installation in a motor vehicle, said system comprising:

a mounting bracket constructed and arranged to be fixedly mounted to the vehicle;

a vehicle jack constructed and arranged to be positioned underneath the vehicle and then moved through raising and lowering movements under a transmittal of force thereto to affect raising and lowering movements of the vehicle;

said jack being removably mounted to said mounting bracket to enable said jack to be removed therefrom for use in affecting the raising and lowering movements of the vehicle as aforesaid;

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer fixedly mounted to the mounting bracket, said tool retainer having a tool receiving space and resiliently movable tool engaging structure providing a tool engaging surface facing into the tool receiving space, the resiliently movable tool engaging structure also providing a cam surface, said jack operating tool being removably mounted to said mounting bracket by being removably received in the tool receiving space of said tool retainer with said tool engaging structure forcibly engaging said tool engaging surface thereof against the exterior surface of said tool to frictionally inhibit movement of the tool in the longitudinal direction thereof;

said tool and said tool retainer being constructed and arranged to enable said tool to be removed for coupling to said jack in said force transmitting relation by moving said tool in the longitudinal direction thereof so as to longitudinally withdraw said jack tool from said tool receiving space;

said tool and said tool retainer being constructed and arranged to enable said tool to be re-mounted to said tool retainer by moving said tool in the longitudinal direction thereof into said tool receiving space such that (a) said tool contacts the cam surface of said tool engaging structure and cams the cam surface to urge said tool engaging structure against the resiliency thereof to accommodate ingress of said tool into said tool receiving space and (b) said tool engaging structure thereafter forcibly engages said tool engaging surface thereof against the exterior surface of said tool to frictionally inhibit movement of the tool in the longitudinal direction thereof.

37. A vehicle jack system according to claim 36, wherein said tool retainer is a tool retaining clip having a base portion fixedly mounted to said mounting bracket and a pair of opposing leg portions with free ends spaced apart from one another, said leg portions and said base portion having interior surfaces defining said tool receiving space of said tool retaining clip, said tool engaging structure being provided by said leg portions, said tool engaging surfaces being provided by said interior surfaces of said tool retaining clips, and said cam surface being provided by engageable edge surfaces of the leg portions, said leg portions being resiliently movable apart from one another, said engageable edge surfaces of said tool engaging structure being configured such that movement of said tool in the longitudinal direction thereof into said tool receiving space engages said tool against said edge surfaces in a camming action so as to move said leg portions apart from one another against the resiliency thereof to accommodate ingress of said tool within said tool receiving space and such that said leg portions thereafter forceably engage said interior surfaces thereof against the exterior surface of said tool to frictionally inhibit movement of the tool in the longitudinal direction thereof.

38. A vehicle jack system according to claim 37, wherein said tool retainer is a first longitudinal entry tool retainer and wherein said system further comprises:

a second longitudinal entry tool retainer having a tool receiving space and resiliently movable tool engaging structure providing a tool engaging surface facing into the tool receiving space, the resiliently movable tool engaging structure of the second tool retainer also providing a cam surface, said second tool retainer being fixedly mounted to said mounting bracket in spaced apart relation from said first tool retainer with said tool receiving spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said tool receiving space of said second tool retainer such that (a) said tool contacts the cam surface of said tool engaging structure of said second tool retainer and cams the cam surface to urge said tool engaging structure of said second tool retainer against the resiliency thereof to accommodate ingress of said tool into said tool receiving space and (b) said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of said first tool retainer.

39. A vehicle jack system according to claim 38, wherein each of said first and second tool retainers is a tool retaining clip having a base portion fixedly mounted to said mounting bracket and a pair of opposing leg portions with free ends spaced apart from one another, said leg portions and said base portion having interior surfaces defining said tool receiving space of each of said tool retaining clips, said tool engaging structure of each of said tool retaining clips being provided by said leg portions, said tool engaging surfaces of each of said tool retaining clips being provided by said interior surfaces of said tool retaining clips, and said cam surfaces of said tool retaining clips being provided by engageable edge surfaces of the leg portions, said leg portions of each of said clips being resiliently movable apart from one another;

said engageable edge surfaces of said tool engaging structure of each tool retaining clip being configured such that movement of said tool in the longitudinal direction thereof into said tool receiving space of each clip engages said tool against said edge surfaces thereof in a camming action so as to move said leg portions thereof apart from one another against the resiliency thereof to accommodate ingress of said tool within said tool receiving space thereof and such that said leg portions thereafter forceably engage said interior surfaces thereof against the exterior surface of said tool to frictionally inhibit movement of the tool in the longitudinal direction thereof.

40. A vehicle jack system according to claim 39, wherein said clips are molded from plastic.

41. A vehicle jack system according to claim 36, wherein said tool is tubular.

42. A vehicle jack system according to claim 36, wherein said tool is straight along its entire longitudinal extent.

43. A vehicle jack system according to claim 36, wherein said tool is bent at a point intermediate said opposing end portions thereof.

44. A vehicle jack system, according to claim 37, wherein said engageable edge surfaces of said tool engaging structure of each tool retaining clip are chamfered.

45. A vehicle jack system, according to claim 39, wherein said engageable edge surfaces of said tool engaging structure of said tool retaining clip are chamfered.

46. A vehicle jack system according to claim 36, wherein said tool receiving space is open to opposing end portions of said tool retainer to enable said tool to be moved therethrough as said tool is being mounted to said tool retainer and wherein said one of said opposing end portions of said tool has a lock button extending through an opening formed in the exterior surface of said tool and a spring mounted within said jack tool adjacent said opening, said lock button being mounted to said spring such that said spring biases said lock button outwardly through said opening to a locking position, said tool retainer being constructed and arranged such that as said one end portion of said tool is moved into said tool receiving space, said lock button engages said cam surface in a camming action to urge said lock button inwardly from the locking position thereof to permit ingress of said tool into said tool receiving space and further such that after said lock button has moved through said tool receiving space and beyond said tool engaging structure said lock button returns to said locking position thereof under the biasing of said spring so that said lock button can engage said tool retainer to inhibit removal of said tool in the longitudinal direction thereof from said tool receiving space.

47. A vehicle jack system according to claim 46, wherein said tool retainer is a tool retaining clip having a base portion fixedly mounted to the vehicle and a pair of opposing leg portions with free ends spaced apart from one another, said leg portions and said base portion having interior surfaces defining said tool receiving space of said tool retaining clip, said tool engaging structure being provided by said leg portions, said tool engaging surfaces being provided by said interior surfaces of said tool retaining clips, and said cam surface being provided by engageable edge surfaces of the leg portions, said leg portions of each clip being resiliently movable apart from one another;

said engageable edge surfaces of said tool engaging structure being configured such that movement of said tool in the longitudinal direction thereof into said tool receiving space (a) engages said jack tool against said edge surfaces in a camming action so as to move said leg portions apart from one another against the resiliency thereof to accommodate ingress of said tool within said tool receiving space and such that said leg portions thereafter forceably engage said interior surfaces thereof against the exterior surface of said tool to frictionally inhibit movement of the jack tool in the longitudinal direction thereof and (b) engages said lock button of said jack tool against one of said edge surfaces in a camming action to urge said lock button inwardly from the locked position thereof to permit ingress of said tool into said tool receiving space.

48. A vehicle jack system according to claim 46, wherein said tool retainer is a first longitudinal entry tool retainer and wherein said system further comprises:

a second longitudinal entry tool retainer having a tool receiving space and resiliently movable tool engaging structure providing a tool engaging surface facing into the tool receiving space, the resiliently movable tool engaging structure of the second tool retainer also providing a cam surface, said second tool retainer being fixedly mounted to the vehicle in spaced apart relation from said first tool retainer with said tool receiving spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said tool receiving space of said second tool retainer such that (a) said tool contacts said tool engaging structure of said second tool retainer and cams the cam surface to urge said tool engaging structure of said second tool retainer against the resiliency thereof to accommodate ingress of said tool into said tool receiving space and (b) said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of the tool engaging structure of said first tool retainer;

said second tool retainer being constructed and arranged such that as said one end portion of said tool is moved into said tool receiving space of said second tool retainer, said lock button engages said second tool retainer in a camming action to urge said lock button inwardly from the locking position thereof to permit ingress of said tool into said tool receiving space of said second tool retainer and further such that after said lock button has moved through said tool receiving space of said second tool retainer, and beyond said tool engaging structure thereof said lock button returns to said locking position thereof under the biasing of said spring so that said lock button can engage said tool retainer to inhibit removal of said tool in the longitudinal direction thereof from said tool receiving space.

49. A vehicle jack system according to claim 48, wherein each of said first and second tool retainers is a tool retaining clip having a base portion fixedly mounted to said mounting bracket and a pair of opposing leg portions with free ends spaced apart from one another, said leg portions and said base portion having interior surfaces defining said tool receiving space of each of said tool retaining clips, said tool engaging structure of said tool retaining clips being provided by said leg portions, said tool engaging surfaces of said tool retaining clips being provided by said interior surfaces of said tool retaining clips, and said cam surfaces of said tool retaining clips being provided by engageable edge surfaces of the leg portions, said leg portions being resiliently movable apart from one another;

said engageable edge surfaces of said tool engaging structures of each tool retaining clip being configured such that movement of said tool in the longitudinal direction thereof into said tool receiving space of each clip (a) engages said tool against said edge surfaces thereof in a camming action so as to move said leg portions thereof apart from one another against the resiliency thereof to accommodate ingress of said tool within said tool receiving space thereof and such that said leg portions thereafter forceably engage said interior surfaces thereof against the exterior surface of said tool to frictionally inhibit movement of the tool in the longitudinal direction thereof and (b) engages said lock button of said tool against one of said edge surfaces in a camming action to urge said lock button inwardly from the locking position thereof to permit ingress of said tool into said tool receiving space.

50. A vehicle jack system according to claim 49, wherein said clips are molded from plastic.

51. A vehicle jack system according to claim 47, wherein said engageable edge surfaces of said tool engaging structure of each tool retaining clip are chamfered.

52. A vehicle jack system according to claim 49, wherein said engageable edge surfaces of each of said tool engaging structures of said tool retaining clip are chamfered.

53. A vehicle jack system for installation in a motor vehicle, said system comprising:

a mounting bracket constructed and arranged to be fixedly mounted to the vehicle;

a vehicle jack constructed and arranged to be positioned underneath the vehicle and then moved through raising and lowering movements under a transmittal of force thereto to affect raising and lowering movements of the vehicle;

said jack being removably mounted to said mounting bracket to enable said jack to be removed therefrom for use in affecting the raising and lowering movements of the vehicle as aforesaid;

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer fixedly mounted to the mounting bracket, said tool retainer having a tool receiving space and resiliently movable tool engaging structure providing a tool engaging surface, said jack operating tool being removably mounted to said mounting bracket by being removably received in the tool receiving space of said tool retainer with said tool engaging structure forcibly engaging said tool engaging surface thereof against the exterior surface of said tool to frictionally inhibit movement of the tool in the longitudinal direction thereof;

said tool and said tool retainer being constructed and arranged to enable said tool to be removed for coupling to said jack in said force transmitting relation by moving said tool in the longitudinal direction thereof so as to longitudinally withdraw said jack tool from said tool receiving space;

said tool and said tool retainer being constructed and arranged to enable said tool to be re-mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool receiving space is open to opposing end portions of said tool retainer to enable said tool to be moved therethrough as said tool is being mounted to said tool retainer and wherein said one of said opposing end portions of said tool has a lock button extending through an opening formed in the exterior surface of said tool and a spring mounted within said jack tool adjacent said opening, said lock button being mounted to said spring such that said spring biases said lock button outwardly through said opening to a locking position, said tool retainer being constructed and arranged such that as said one end portion of said tool is moved into said tool receiving space, said lock button engages said tool retainer in a camming action to urge said lock button inwardly from the locking position thereof to permit ingress of said tool into said tool receiving space and further such that after said lock button has moved through said tool receiving space and beyond said tool engaging structure said lock button returns to said locking position thereof under the biasing of said spring so that said lock button can engage said tool retainer to inhibit removal of said tool in the longitudinal direction thereof from said tool receiving space;

wherein said tool engaging structure includes one or more deformable ribs extending into said tool receiving space.

54. A vehicle jack system according to claim 53, wherein said tool retainer includes an annular wall surrounding said tool receiving space and wherein said one or more deformable ribs include a plurality of said deformable ribs disposed on an interior surface of said wall.

55. A vehicle jack system for installation in a motor vehicle, said system comprising:

a mounting bracket constructed and arranged to be fixedly mounted to the vehicle;

a vehicle jack constructed and arranged to be positioned underneath the vehicle and then moved through raising and lowering movements under a transmittal of force thereto to affect raising and lowering movements of the vehicle;

said jack being removably mounted to said mounting bracket to enable said jack to be removed therefrom for use in affecting the raising and lowering movements of the vehicle as aforesaid;

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer fixedly mounted to the mounting bracket, said tool retainer having a tool receiving space and resiliently movable tool engaging structure providing a tool engaging surface, said jack operating tool being removably mounted to said mounting bracket by being removably received in the tool receiving space of said tool retainer with said tool engaging structure forcibly engaging said tool engaging surface thereof against the exterior surface of said tool to frictionally inhibit movement of the tool in the longitudinal direction thereof;

said tool and said tool retainer being constructed and arranged to enable said tool to be removed for coupling to said jack in said force transmitting relation by moving said tool in the longitudinal direction thereof so as to longitudinally withdraw said jack tool from said tool receiving space;

said tool and said tool retainer being constructed and arranged to enable said tool to be re-mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool receiving space is open to opposing end portions of said tool retainer to enable said tool to be moved therethrough as said tool is being mounted to said tool retainer and wherein said one of said opposing end portions of said tool has a lock button extending through an opening formed in the exterior surface of said tool and a spring mounted within said jack tool adjacent said opening, said lock button being mounted to said spring such that said spring biases said lock button outwardly through said opening to a locking position, said tool retainer being constructed and arranged such that as said one end portion of said tool is moved into said tool receiving space, said lock button engages said tool retainer in a camming action to urge said lock button inwardly from the locking position thereof to permit ingress of said tool into said tool receiving space and further such that after said lock button has moved through said tool receiving space and beyond said tool engaging structure said lock button returns to said locking position thereof under the biasing of said spring so that said lock button can engage said tool retainer to inhibit removal of said tool in the longitudinal direction thereof from said tool receiving space;

wherein said tool retainer is a first longitudinal entry tool retainer and wherein said system further comprises:

a second longitudinal entry tool retainer having a tool receiving space and resiliently movable tool engaging structure providing a tool engaging surface, said second tool retainer being fixedly mounted to the vehicle in spaced apart relation from said first tool retainer with said tool receiving spaces of said first and second tool retainers being generally aligned with one another said tool and said second tool retainer being constructed and arranged to enable said tool to be mounted to said second tool retainer after mounting said tool to said first tool retainer as aforesaid by continuing to move said tool in the longitudinal direction thereof into said tool receiving space of said second tool retainer such that said tool contacts said tool engaging structure of said second tool retainer and urges said tool engaging structure of said second tool retainer against the resiliency thereof to accommodate ingress of said tool into said tool receiving space and such that said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of the tool engaging structure of said first tool retainer;

said second tool retainer being constructed and arranged such that as said one end portion of said tool is moved into said tool receiving space of said second tool retainer, said lock button engages said second tool retainer in a camming action to urge said lock button inwardly from the locking position thereof to permit ingress of said tool into said tool receiving space of said second tool retainer and further such that after said lock button has moved through said tool receiving space of said second tool retainer, and beyond said tool engaging structure thereof said lock button returns to said locking position thereof under the biasing of said spring so that said lock button can engage said tool retainer to inhibit removal of said tool in the longitudinal direction thereof from said tool receiving space;

wherein said tool engaging structure of said first tool retainer includes one or more deformable ribs extending into the tool receiving space of said first tool retainer and wherein the tool engaging structure of said second tool retainer includes one or more deformable ribs extending into the tool receiving space of said second tool retainer.

56. A vehicle jack system according to claim 55, wherein said first tool retainer includes an annular wall surrounding said tool receiving space thereof and wherein said one or more deformable ribs of said first tool retainer includes a plurality of said deformable ribs disposed on an interior surface of said wall;

wherein said second tool retainer includes a annular wall surrounding said tool receiving space and wherein said one or more deformable ribs of said second tool retainer includes a plurality of ribs disposed on an interior surface of said wall.

57. A vehicle jack system for installation in a motor vehicle, said system comprising:

a mounting bracket constructed and arranged to be fixedly mounted to the vehicle;

a vehicle jack constructed and arranged to be positioned underneath the vehicle and then moved through raising and lowering movements under a transmittal of force thereto to affect raising and lowering movements of the vehicle;

said jack being removably mounted to said mounting bracket to enable said jack to be removed therefrom for use in affecting the raising and lowering movements of the vehicle as aforesaid;

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer fixedly mounted to the mounting bracket, said tool retainer having a tool receiving space and resiliently movable tool engaging structure providing a tool engaging surface, said jack operating tool being removably mounted to said mounting bracket by being removably received in the tool receiving space of said tool retainer with said tool engaging structure forcibly engaging said tool engaging surface thereof against the exterior surface of said tool to frictionally inhibit movement of the tool in the longitudinal direction thereof;

said tool and said tool retainer being constructed and arranged to enable said tool to be removed for coupling to said jack in said force transmitting relation by moving said tool in the longitudinal direction thereof so as to longitudinally withdraw said jack tool from said tool receiving space;

said tool and said tool retainer being constructed and arranged to enable said tool to be re-mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool engaging structure includes one or more deformable ribs extending into said tool receiving space.

58. A vehicle jack system according to claim 57, wherein said tool retainer includes an annular wall surrounding said tool receiving space and wherein said one or more deformable ribs include a plurality of said deformable ribs disposed on an interior surface of said wall.

59. A vehicle jack system for installation in a motor vehicle, said system comprising:

a mounting bracket constructed and arranged to be fixedly mounted to the vehicle;

a vehicle jack constructed and arranged to be positioned underneath the vehicle and then moved through raising and lowering movements under a transmittal of force thereto to affect raising and lowering movements of the vehicle;

said jack being removably mounted to said mounting bracket to enable said jack to be removed therefrom for use in affecting the raising and lowering movements of the vehicle as aforesaid;

an elongated rigid jack operating tool having an exterior surface and a pair of opposing end portions spaced apart in a longitudinal direction thereof, at least one of said end portions being constructed and arranged to be coupled in force transmitting relation with the vehicle jack such that moving the tool transmits force to the jack to move the jack through the aforesaid raising and lowering movements thereof;

a longitudinal entry tool retainer fixedly mounted to the mounting bracket, said tool retainer having a tool receiving space and resiliently movable tool engaging structure providing a tool engaging surface, said jack operating tool being removably mounted to said mounting bracket by being removably received in the tool receiving space of said tool retainer with said tool engaging structure forcibly engaging said tool engaging surface thereof against the exterior surface of said tool to frictionally inhibit movement of the tool in the longitudinal direction thereof;

said tool and said tool retainer being constructed and arranged to enable said tool to be removed for coupling to said jack in said force transmitting relation by moving said tool in the longitudinal direction thereof so as to longitudinally withdraw said jack tool from said tool receiving space;

said tool and said tool retainer being constructed and arranged to enable said tool to be re-mounted to said tool retainer by moving said tool in the longitudinal direction thereof into said tool receiving space such that said tool contacts said tool engaging structure and urges said tool engaging structure against the resiliency thereof to accommodate ingress of said tool into said tool receiving space and such that said tool engaging structure thereafter forcibly engages said tool engaging surface thereof against the exterior surface of said tool to frictionally inhibit movement of the tool in the longitudinal direction thereof;

wherein said tool retainer is a first longitudinal entry tool retainer and wherein said system further comprises:

a second longitudinal entry tool retainer having a tool receiving space and resiliently movable tool engaging structure providing a tool engaging surface, said second tool retainer being fixedly mounted to said mounting bracket in spaced apart relation from said first tool retainer with said tool receiving spaces of said first and second tool retainers being generally aligned with one another;

said tool and said second tool retainer being constructed and arranged to enable said tool to be mounted to said second tool retainer after mounting said tool to said first tool retainer as aforesaid by continuing to move said tool in the longitudinal direction thereof into said tool receiving space of said second tool retainer such that said tool contacts said tool engaging structure of said second tool retainer and urges said tool engaging structure of said second tool retainer against the resiliency thereof to accommodate ingress of said tool into said tool receiving space and such that said tool engaging structure of said second tool retainer thereafter forcibly engages said tool engaging surface thereof against the exterior surface of said tool to frictionally inhibit movement of the tool in the longitudinal direction thereof in cooperation with said tool engaging surface of said first tool retainer;

wherein said tool engaging structure of said first tool retainer includes one or more deformable ribs extending into the tool receiving space of said first tool retainer and wherein the tool engaging structure of said second tool retainer includes one or more deformable fibs extending into the tool receiving space of said second tool retainer.

60. A vehicle jack system according to claim 59, wherein said first tool retainer includes an annular wall surrounding said tool receiving space thereof and wherein said one or more deformable ribs of said first tool retainer includes a plurality of said deformable ribs disposed on a interior surface of said wall;

wherein said second tool retainer includes a annular wall surrounding said tool receiving space and wherein said one or more deformable ribs of said second tool retainer includes a plurality of ribs disposed on an interior surface of said wall.

* * * * *